US006631985B2

(12) United States Patent
Koizumi et al.

(10) Patent No.: US 6,631,985 B2
(45) Date of Patent: Oct. 14, 2003

(54) INK-JET TEXTILE PRINTING SYSTEM, INK-JET TEXTILE PRINTING APPARATUS, AND INK-JET TEXTILE PRINTING METHOD

(75) Inventors: Shigeki Koizumi, Saitama (JP); Shoji Koike, Kanagawa (JP); Makoto Aoki, Kanagawa (JP); Koromo Shirota, Kanagawa (JP); Minoru Kobayashi, Saitama (JP)

(73) Assignees: Canon Denshi Kabushiki Kaisha, Chichibu (JP); Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/987,296

(22) Filed: Nov. 14, 2001

(65) Prior Publication Data

US 2002/0060728 A1 May 23, 2002

(30) Foreign Application Priority Data

Nov. 17, 2000 (JP) ..... 2000-351022
Nov. 17, 2000 (JP) ..... 2000-351023
Nov. 17, 2000 (JP) ..... 2000-351024

(51) Int. Cl.[7] ..... B41J 2/01; B41J 3/407
(52) U.S. Cl. ..... 347/101; 347/106
(58) Field of Search ..... 347/4, 96, 98, 347/101, 104, 106; 101/121, 35

(56) References Cited

U.S. PATENT DOCUMENTS 3,744,412 A * 7/1973 Grue et al. ..... 101/114
4,368,476 A * 1/1983 Uehara et al. ..... 347/45
5,090,313 A * 2/1992 Chapman ..... 101/129
5,380,769 A * 1/1995 Titterington et al. ..... 523/161
5,635,969 A * 6/1997 Allen ..... 347/96
5,635,970 A 6/1997 Shirota et al.
5,854,642 A 12/1998 Takahashi et al.
5,872,579 A 2/1999 Handa et al.
5,963,236 A 10/1999 Miyashita et al.
6,095,628 A * 8/2000 Rhome ..... 347/4
6,254,231 B1 7/2001 Suzuki et al.

FOREIGN PATENT DOCUMENTS

JP 7-336466 * 12/1995
JP 11-138768 * 5/1999

* cited by examiner

*Primary Examiner*—Judy Nguyen
*Assistant Examiner*—Michael S Brooke
(74) *Attorney, Agent, or Firm*—Fitzpatrick, Cella, Harper & Scinto

(57) ABSTRACT

An ink-jet textile printing system includes an ink-jet printing mechanism capable of textile printing on a printing object formed by a cloth product such as a T-shirt, a printing tray for holding a printing target range of the printing object flat, and conveying the printing object while positioning the printing target range with respect to the ink-jet printing mechanism, and a printing object formed by a cloth product such as a T-shirt having a partial pre-process portion obtained by partially pre-processing only the printing target range.

9 Claims, 13 Drawing Sheets

INK-JET TEXTILE PRINTING SYSTEM, INK-JET TEXTILE PRINTING APPARATUS, AND INK-JET TEXTILE PRINTING METHOD

BACKGROUND OF THE INVENTION

1. Field of the Invention

The present invention relates to an ink-jet textile printing system for performing textile printing on a printing object formed by a cloth product such as a T-shirt.

2. Related Background Art

As conventional methods of printing images (including characters and symbols) on cloth products (clothing and the like) such as T-shirts, screen printing, iron printing (transfer printing), and the like are known.

In the above screen printing method, a paste colored with a pigment is applied to a printing object (printing target) through a permeable portion formed on a screen in a predetermined pattern, and the paste is fixed in the printing object by using the binding force of the paste. When multicolor printing is to be performed by this screen printing method, a plurality of screen plates corresponding to the respective colors are used for recoating.

In the above iron printing method, after a picture is printed on a transfer sheet by a color toner copying machine, ink-jet printer, or the like, the printed transfer sheet is transferred onto a cloth product (clothing or the like) such as a T-shirt by hot press.

Recently, a digital textile printing method is often used. In this method, after an image is directly printed on a piece of cloth having undergone a pre-process, by using an ink-jet printer, and the printed cloth is post-processed, the cloth is sewn into clothing (cloth product) such as a T-shirt. Such digital textile printing methods using conventional ink-jet printers are disclosed in, for example, Japanese Patent Application Laid-Open No. 7-336466 and U.S. Pat. No. 5,872,579.

In the screen printing method, however, a plurality of special plates corresponding to different designs and colors are required, and it takes much time and cost to manufacture such plates. This method is therefore unsuitable for large variety of and small amount of production and shortening of a supply period. In addition, many steps are required to store and manage plates in printing (copying) the same image on a plurality of cloth products. Furthermore, the above screen printing method suffers a technical problem. That is, it is difficult to print a high-resolution picture.

In the above iron printing method, since the resin of a transfer sheet is caused to adhere to the surface of a printing object in the printing process, the printing object loses air permeability and becomes tough. Another technical problem is that when a picture is printed on clothing such as a T-shirt, the clothing becomes impervious to sweat and hence become uncomfortable. Furthermore, the washing fastness of the printing object deteriorates; when the printing object is washed, it quickly becomes worn.

The above digital textile printing method has been proposed to solve the above drawbacks. However, to perform textile printing on a printing object such as clothing made of fibers, many processes including a pre-process, a color development fixing process and a post-process such as cleaning are required. In addition, owing to the difficulty of the process method and the problem associated with the process time, a printing object on which a picture is printed while the printing object remains as a piece of cloth must be sewn into a cloth product. For this reason, the conventional digital textile printing method has a difficulty in realizing on-demand operation in theme parks, tourist resorts, and the like.

SUMMARY OF THE INVENTION

It is an object of the present invention to provide a compact, inexpensive ink-jet textile printing system which can easily perform textile printing on a cloth product such as a T-shirt on demand.

It is another object of the present invention to provide a compact, inexpensive ink-jet textile printing system in which a printing object, only a specific printing target range of which has undergone a partial pre-process, is stocked as a standard product, and a printing tray for conveying the printing object while positioning the partial pre-process portion of the printing object with respect to an ink-jet printing mechanism is used in printing operation, whereby a picture can be directly printed on the printing object, on-demand textile printing is facilitated by eliminating the necessity of the steps of applying a preconditioning agent and drying it in printing operation to easily perform textile printing on the cloth product such as a T-shirt on demand, the demands for original prints can be satisfied, and new demands for print cloth products as commemorative goods can be created in tourist resorts, theme parks, and the like.

It is still another object of the present invention to provide an ink-jet textile printing apparatus and ink-jet textile printing method which can easily form a compact, inexpensive textile printing system capable of printing a high-resolution digital picture in a specific printing target range of a cloth product such as a T-shirt without a plate on demand with comfort and high washing fastness being ensured.

It is still another object to provide an ink-jet textile printing apparatus and ink-jet textile printing method which print on a printing object, only a specific printing target range of which has undergone a partial pre-process, while positioning the partial pre-process portion for printing by using a printing tray, thereby minimizing the flat area of the printing tray in accordance with the partial pre-process portion and allowing the apparatus to be easily installed in a store or the like.

It is still another object of the present invention to provide an ink-jet textile printing apparatus and ink-jet textile printing method which can clean only a partial pre-process portion using a compact cleaning means in the cleaning step by setting only a specific printing target range as a partial pre-process portion, and need only perform almost all steps from a pre-process to cleaning for only the partial pre-process portion, thereby facilitating the textile printing process and reducing the size of the textile printing apparatus.

It is still another object of the present invention to provide an ink-jet textile printing apparatus and ink-jet textile printing method which can easily keep a partial pre-process portion of a printing object formed by a cloth product such as a T-shirt flat with respect to a printing mechanism and position the partial pre-process portion with respect to the printing mechanism, and can accurately print a printing picture at a specific position.

It is still another object of the present invention to provide an ink-jet textile printing apparatus and ink-jet textile printing method which can prevent a printing object from being smeared with ink or the like by hiding non-print portions inside a printing tray.

It is still another object of the present invention to provide an ink-jet textile printing apparatus and ink-jet textile printing method which can easily realize on-demand operation by directly printing on a printing object formed by a cloth product (clothing or the like) such as a standard T-shirt using an ink-jet printing mechanism, and prevent the problem of overstocked inventories by processing printing objects in accordance with the demand.

It is still another object of the present invention to provide an ink-jet textile printing apparatus and ink-jet textile printing method which improve operability by making it easy to mount a printing object on a printing tray.

DETAILED DESCRIPTION OF THE PREFERRED EMBODIMENTS

Embodiments of the present invention will be described in detail below with reference to the accompanying drawings. In the following embodiments, a cloth product as a printing object is a T-shirt which is a cotton product, and textile printing is performed for the T-shirt.

<First Embodiment>

Figure 1:
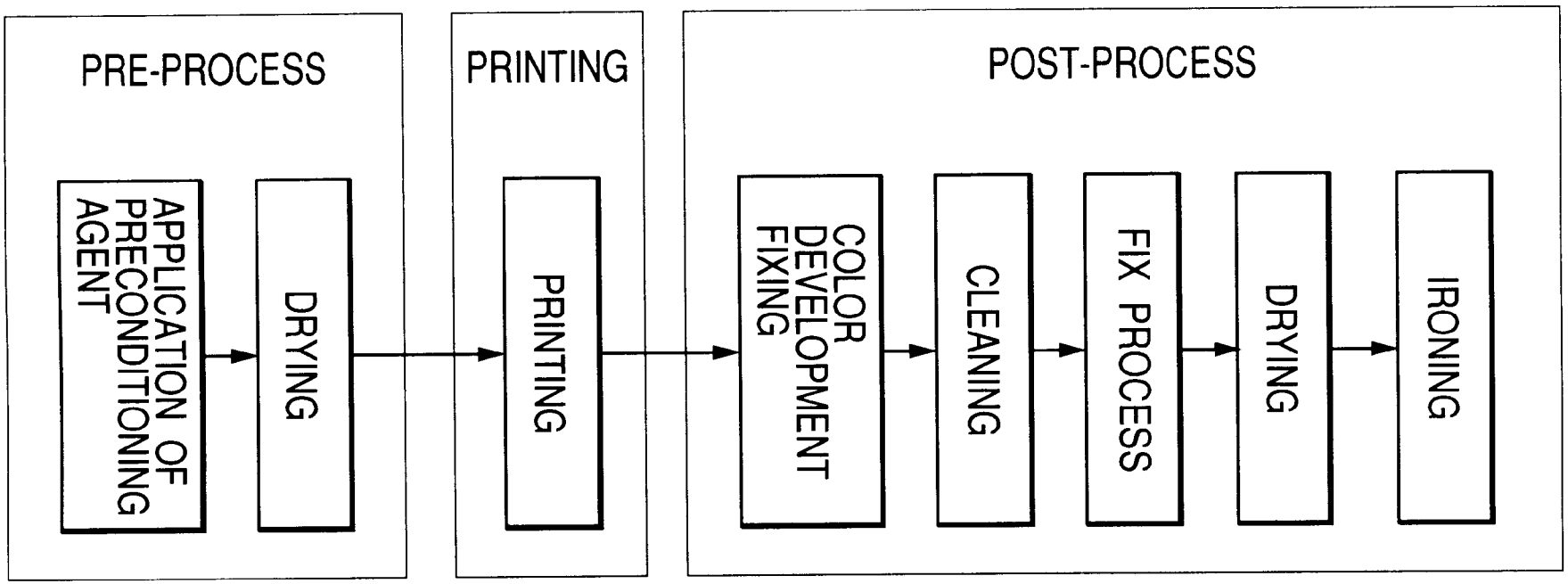
FIG. 1 is a block diagram showing an example of the overall textile printing process performed by an ink-jet textile printing system to which the present invention is applied.

FIG. 1 is a block diagram showing the process of textile-printing a picture on a cloth product (T-shirt) by using the present invention. Referring to FIG. 1, in the pre-process, a preconditioning agent is applied to a T-shirt or the like as a printing object before application of a dye in printing in order to prevent ink from spreading (or blurring) and promote the reaction of the dye with respect to cloth fibers (cotton fibers or the like). The pre-process is constituted by application of a preconditioning agent and drying, as shown in FIG. 1.

As a method of applying a preconditioning agent, a dipping method is generally used. However, a method of partly applying a preconditioning agent by using a spray, sponge roller, or the like may be used. As this preconditioning agent, a material obtained by containing a nonion or anion surfactant in at least one of a water repellent and water soluble resin is preferably used. The water repellent and water soluble resin serve to suppress smearing (or blurring) of an image and retain a dye on the surface of cloth (fabric) so as to improve the color development property. The nonion and anion surfactants serve to prevent the liquid catalyst in ink from excessively infiltrating into the fabric in its depth direction and improve the wettability of a dye with respect to the fabric.

After a pre-process is performed for a print target range on a printing object (a cloth product such as a T-shirt), a picture/image is printed on the print target range (partial pre-process portion) by an ink-jet printing mechanism. A post-process is further performed for the printed object. This post-process is constituted by the following steps: color development fixing, cleaning, fixing (FIX step), drying, and ironing, as shown in FIG. 1.

The above color development fixing is the reactive fixing step for a dye. More specifically, in general, as the reactive fixing step, the heat color development step is preferably performed. In general, a conventional technique, e.g., a known method practiced in a textile printing process, is directly applied to this heat color development step. More specifically, a high-temperature steam process or thermosol process is used.

Although the actual process conditions in the above heat color development process (color development fixing) vary depending on the type of cloth material for a printing object, when a piece of cotton or silk cloth is to be dyed with ink containing a reactive dye, the cloth is preferably processed by a high-temperature steam process at 100° C. to 105° C. for 5 to 30 min. When polyester fiber cloth is to be dyed with ink containing a disperse dye, the cloth is preferably processed by the high-temperature steam method at 160° C. to 180° C. for several to several 10 min, or by the thermosol method at 190° C. to 230° C. for several to several 10 sec.

In the cleaning step in the post-process, a method of soaping with an aqueous solution containing a soaping agent after water washing (including hot water washing) is generally used. If the printing object is polyester cloth, the following method is used as a standard method. After water washing is performed, reduction cleaning is performed with an aqueous solution containing an alkaline agent and hydrosulfide, and water washing is further performed. If the printing object is cotton cloth, soaping is performed with an aqueous solution containing a soaping agent after water washing (including hot water washing). In this case, the washing fastness of the cloth can be improved by executing a fixing process like that shown in FIG. 1 after the above process. In this fixing process, to improve the washing fastness, a dye binder such as a fixing agent is used, and an excess of the dye is removed. As the fixing agent, a material that bonds with a hydrophilic group such as a sulfonic group in the reactive dye to transform the reactive dye into a water insoluble compound is used. More specifically, examples of this material are a polyamine compound, a dicyandiamide compound, a quaternary ammonium salt compound, and the like.

Figure 2:
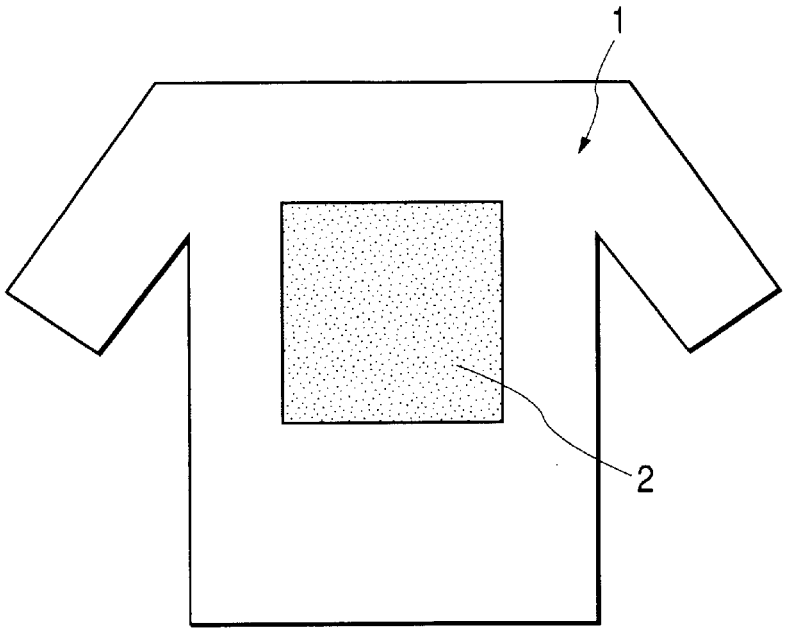
FIG. 2 is a plan view showing a T-shirt as an example of a printing object subjected to textile printing by the present invention and the range of the partial pre-process portion (printing target range) of the T-shirt.

FIG. 2 is a schematic plan view showing a partial pre-process for a T-shirt as an example of a printing object (cloth product). Referring to FIG. 2, a T-shirt 1 has a range 2 (indicated by "□" in FIG. 2) of a partial pre-process portion set on the chest portion of the T-shirt 1. In most cases, printing (printing of a picture/image) on the T-shirt 1 is performed at a predetermined position such as a chest portion within a predetermined size such as A4 portrait/A4 landscape, and a portion with a position and size that can satisfy these conditions is set as a printing target range to be subjected to a partial pre-process. This makes it possible to meet most of print requests. Referring to FIG. 2, in particular, the partial pre-process portion (the range of a pre-processed chest portion) 2 is a square which has a side almost corresponding to the length of A4 portrait size, and hence either an A4 landscape or A4 portrait picture can be properly handled.

Figure 3:
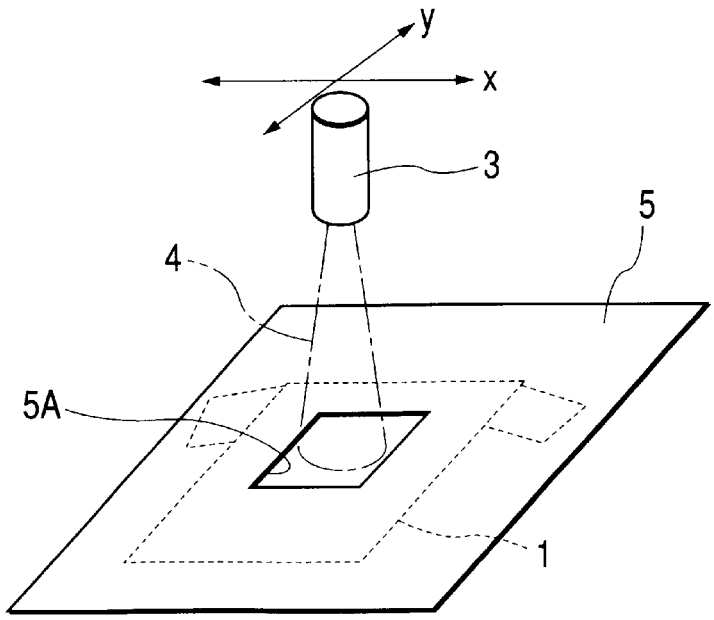
FIG. 3 is a schematic view showing the concept of spray coating as a partial coating method of coating a printing object with a preconditioning agent.

As a method of partially applying a preconditioning agent in the pre-process (FIG. 1), a method using a spray or sponge roller may be used. FIG. 3 is a schematic view showing the concept of a spray coating method as a partial application method of applying the preconditioning agent on the partial pre-process portion (printing target range) 2. FIG. 3 shows a cloth product such as a T-shirt serving as the printing object 1, the partial pre-process portion (printing target range) 2, a spray nozzle 3, a preconditioning agent 4, and a mask 5 that covers a portion of the printing object (T-shirt) 1 which is not pre-processed (a portion other than the printing target range), and an opening portion 5A formed in the mask 5 in correspondence with the partial pre-process portion 2 of the printing object 1.

When the partial pre-process portion 2 is to be coated with the preconditioning agent 4, a specific range (in which a partial pre-process is performed) is marked and indicated with a chalk pen or seal, and the mask 5 is masked in accordance with this specific range. A preconditioning agent may be applied onto the specific range. When the preconditioning agent is applied by this method, the marking made by the chalk pen or seal can be used as a marking for positioning with respect to a printing tray (to be described later), and hence can be used as a positioning mark for the printing object 1 with respect to an ink-jet printing mechanism (printer).

Instead of the method of making the partial pre-process portion 2 recognizable by using a chalk pen or seal in this manner, a method of making the partial pre-process portion 2 identifiable by forming the partial pre-process portion with a colored preconditioning agent may be used. With such an identifying means based on coloring, the formed portion can be used as a mark for positioning with respect to the printing tray, and hence can be used as a positioning mark for the printing object 1 with respect to the ink-jet printing mechanism (printer).

Figure 4:
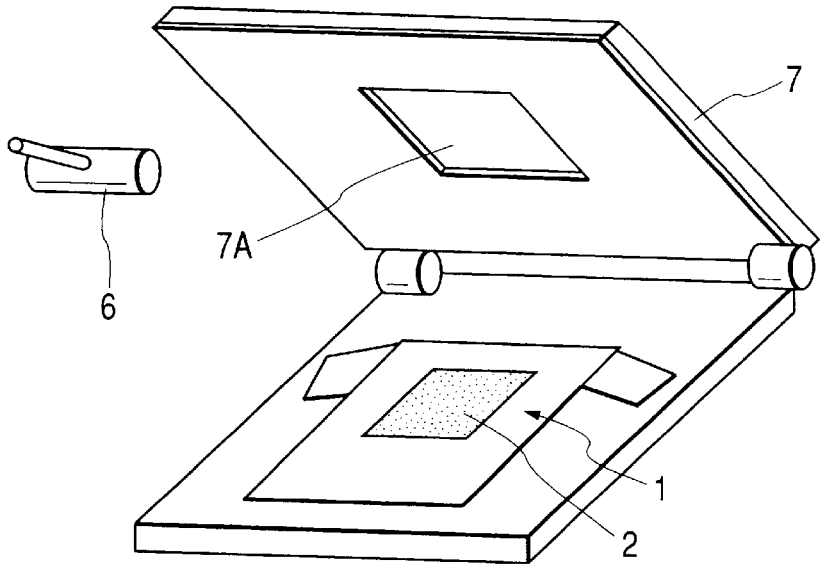
FIG. 4 is a schematic view showing the concept of sponge roller coating as a partial coating method of coating a printing object with a preconditioning agent.

FIG. 4 is a schematic view showing the concept of a sponge roller coating method as a partial application method of applying a preconditioning agent onto the partial pre-process portion 2. FIG. 4 shows the printing object 1 which is a cloth product such as a T-shirt, the partial pre-process portion (printing target range) 2, a sponge roller 6, and a screen table 7. An opening portion 7A corresponding to the range and position of the partial pre-process portion 2 of the printing object 1 is formed in the screen table 7.

Merits in partially applying a preconditioning agent onto a partial pre-process portion are that the amount of preconditioning agent used can be minimized, and the drying time can be shortened. In addition, if a cloth product such as a T-shirt is a cotton product, shrinkage and torsion of the cloth product can be minimized when it is dried.

The following are the merits in spray coating. In general, textile printing by ink-jet printing is performed to dye only the surface of a cloth material. For this reason, by pre-processing only a specific portion of the surface of the cloth material by spray coating, the merits of the partial coating process are enhanced, and spreading (or blurring) of the preconditioning agent from the specific portion can be prevented. This makes it possible to easily and reliably position the material with respect to the printing tray and specify a portion to be cleaned.

Obviously, if printing is required on a special portion of the printing object 1 in a special size, the partial pre-process portion (printing target range) 2 may be individually pre-processed by spray coating or sponge roller coating, and a printing tray (to be described later) having a shape matching with the special portion and size may be prepared.

The ink-jet textile printing system according to the present invention therefore includes an ink-jet printing mechanism capable of textile-printing on a printing object which is a cloth product such as a T-shirt, a printing tray for holding the printing target range of the printing object flat and conveying the printing object while positioning the printing target range with respect to the ink-jet printing mechanism, and a printing object which has a pre-process portion formed by partially pre-processing only the printing target range and which is a cloth product such as a T-shirt to be stored as a standard product.

Figure 5:
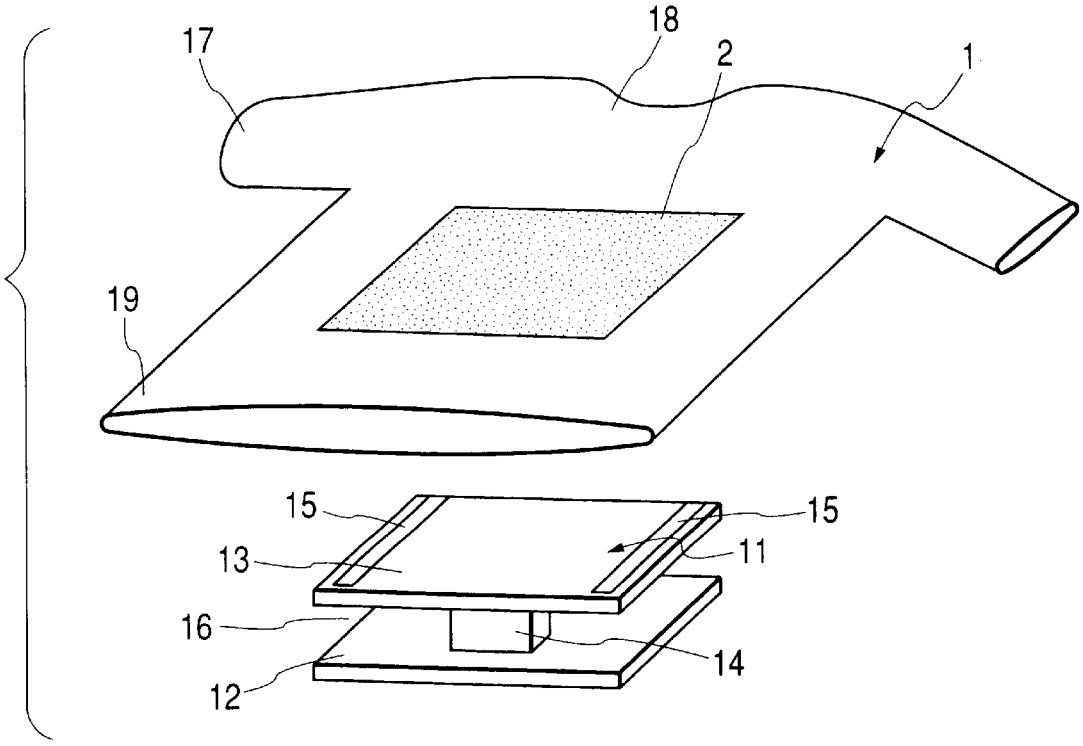
FIG. 5 is a schematic perspective view showing a printing object and a printing tray used in the ink-jet textile printing system to which the present invention is applied, in a separate state.
Figure 6:
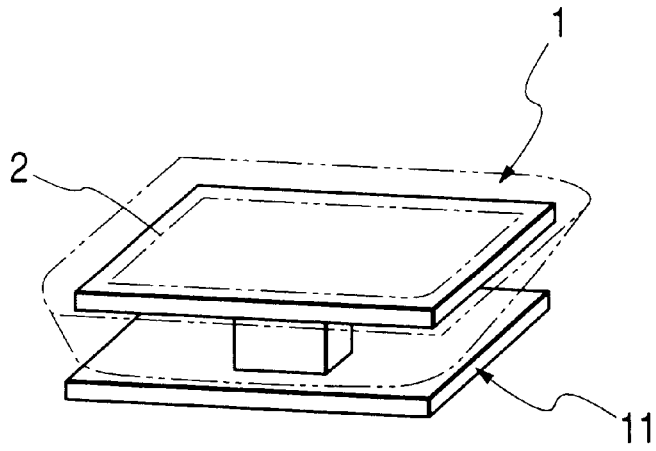
FIG. 6 is a schematic perspective view showing a state wherein the printing object in FIG. 5 is mounted on the printing tray in FIG. 5.

FIG. 5 is a schematic perspective view showing the printing tray and a printing object (T-shirt) to be placed on the printing tray in a separate state. FIG. 6 is a schematic perspective view showing a state wherein a printing object (T-shirt) is placed on the printing tray in FIG. 5. Referring to FIGS. 5 and 6, a printing tray 11 is an H-shaped structure as a whole formed by coupling a lower plate 12, upper plate 13, and support 14. The upper plate 13 is formed flat to allow the cloth product 1 such as a T-shirt which is a printing object to be placed (mounted) flat on the upper surface of the upper plate 13. The size of the upper plate 13 (the area of its upper surface) is almost equal to that of the partial pre-process portion 2 of the printing object 1. This makes it possible to minimize the area of the upper surface of the printing tray 11. Note that if the partial pre-process portion 2 of the printing object (T-shirt) 1 is marked with a chalk pen, seal, or the like (marking that can be washed out), the printing object 1 can be easily positioned/mounted on the printing tray 11.

At least one of the upper surface and side surface of the printing tray 11 (upper plate 13 in FIG. 5) is entirely or partially coated with adhesive members 15 such as an industrial paste with weak adhesive strength or adhesive tape, thus providing the printing tray 11 with adhesive strength. This allows the printing object 1 mounted on the printing tray 11 to be lightly held on the printing tray 11. This makes it possible to prevent the printing object 1 from floating from the printing surface formed on the upper surface of the printing tray 11 and contacting the ink-jet head, and also prevent a positional shift during operation (printing).

In addition, the printing tray 11 has an H-like shape as a whole to hold the partial pre-process portion (printing target range) 2 of the printing object 1 flat, as described above, and position/mount the printing object 1 on the printing tray while the remaining portion of the printing object 1 is folded inside the printing tray. That is, by folding arm portions 17, neck portion 18, hem portion 19, and the like of the T-shirt (printing object) in a pocket portion 16 of the printing tray 11, the plane area of the printing tray 11 on which the printing object 1 is mounted can be minimized, and the size of the ink-jet printing mechanism can also be minimized.

The size (area) of the upper plate 13 may be changed in accordance with the size of the printing object 1, e.g., a child-size T-shirt and adult-size T-shirt. Note that the size of the lower plate 12 may remain the same, and the support 14 is formed at a position slightly shifted from the center of the printing tray 11 to allow the printing object 1 such as a T-shirt to be easily placed on the printing tray. No special limitation is imposed on the material for the printing tray 11, and hence a desired material such as a wood, plastic, or metal material can be used. Since the printing tray 11 is formed into an H-like shape as described above, and the printing object (T-shirt) 1 is placed on the upper plate 13 so as to cover it, even if the printing object is a thin material, ink can be prevented from spreading to the lower surface of the printing object 1 in printing a picture on the printing object.

Figure 7:
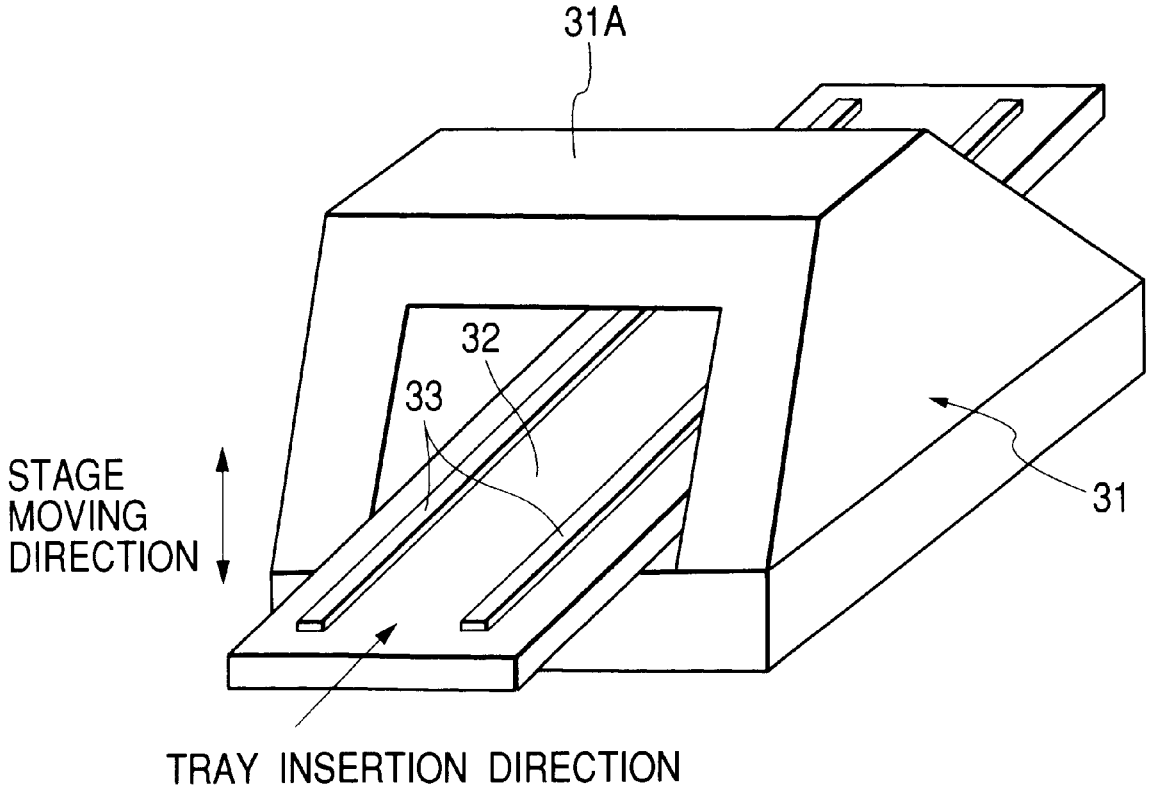
FIG. 7 is a schematic perspective view showing an embodiment of an ink-jet printing mechanism used in the ink-jet textile printing system to which the present invention is applied.

FIG. 7 is a schematic perspective view of an embodiment of the ink-jet printing mechanism (printer) used in the ink-jet textile printing system to which the present invention is applied. Referring to FIG. 7, an ink-jet printing mechanism 31 directly prints (ink-jet prints) a desired picture on the printing object 1. The printing tray 11 (see FIG. 6) on which the printing object 1, e.g., a T-shirt, is mounted is conveyed through the ink-jet printing mechanism 31 by convey belts 33 mounted on a stage 32. During this conveyance, a predetermined picture is printed in a desired range (the partial pre-process portion 2 supported flat on the upper surface of the upper plate 13 of the printing tray 11) of the printing object 1 positioned/mounted on the printing tray 11 by the ink-jet printing mechanism 31 (its ink-jet head or dye ink discharged from the ink discharging opening).

The ink-jet printing mechanism 31 has a printing portion with a substantially gate-like shape as shown in FIG. 7, and an ink-jet unit (not shown) is placed inside a top beam 31A. The ink-jet unit is designed to print an image in the printing target range (partial pre-process portion) 2 of the printing object 1 by discharging ink from the discharging opening on the basis of image information.

Examples of the print unit are a unit based on the serial printing scheme of forming an image by alternately repeating 1-line printing by main scanning of the printhead which reciprocates in a direction crossing the convey direction of the printing object 1 and pitch feeding (pitch conveyance) of the printing object 1, and a unit based on the line printing scheme of printing an image by performing only pitch feeding (subscanning) in the convey direction of the printing object 1 using a line-type printhead having a predetermined length in the width direction of the printing object 1.

Such an ink-jet printing mechanism is disclosed in U.S. Pat. No. 5,872,579.

The printing tray 11 on which the printing object 1 is mounted is conveyed by the following mechanism. The printing tray 11 is guided along the width direction of the stage 32 by the width guides (not shown) of the lower plate 12 of the printing tray 11 and the stage 32. The leading portion of the printing tray 11 in the convey direction is detected when a detection switch (not shown) mounted on the stage 32 detects the leading portion of the lower plate 12 of the printing tray 11. When the leading portion of the printing tray 11 in the convey direction is detected, the stage 32 is moved upward until the partial pre-process portion 2 of the printing object 1 placed on the upper plate 13 of the printing tray 11 comes into contact with an upper surface detection switch (not shown) on the ink-jet printing mechanism 31. With this operation, the gap between the partial pre-process portion (printing target range) 2 and the ink-jet head is adjusted. After this gap adjustment, the printing mode is started, in which dye ink is discharged from the ink-jet head to print a picture on the partial pre-process portion.

By positioning the printing tray 11 with respect to the ink-jet printing mechanism 31 in the above manner, the printing object 1 mounted on the printing tray can be positioned to the ink-jet printing mechanism 31 (its ink-jet head or discharging opening). When printing on the printing object 1 is complete, the stage 32 is lowered to the initial standard level, and the printing tray 11 on which the printing object 1 is mounted is discharged from the stage 32.

The ink-jet printer (printhead) is formed by an ink-jet means having electrothermal transducers for generating heat energy used to discharge ink. This ink-jet means prints by discharging ink from discharge openings using film boiling caused in the ink by the heat energy generated by the electrothermal transducers.

Figure 22:
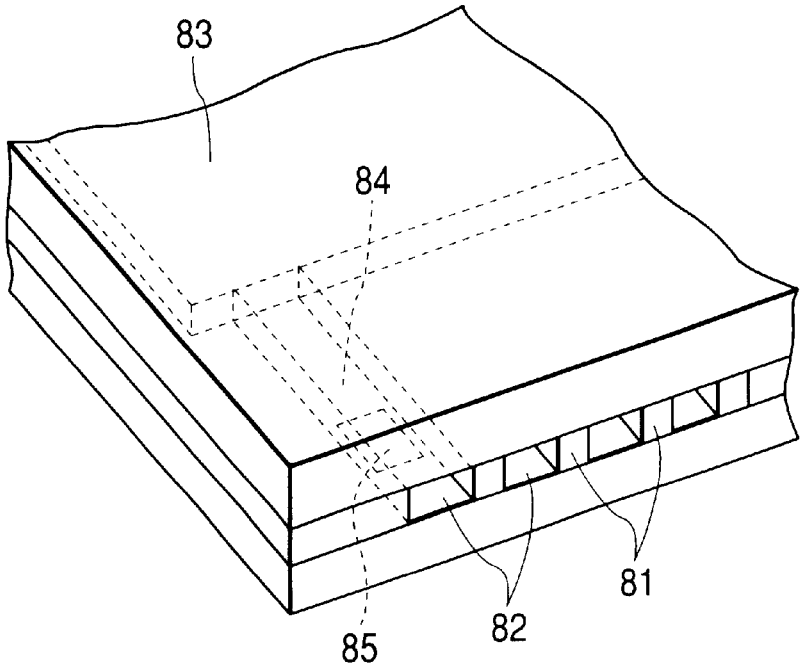
FIG. 22 is a partial perspective view schematically showing the structure of the ink discharging portion of an ink-jet unit based on the serial printing scheme.

FIG. 22 is a partial perspective view schematically showing the structure of the ink discharging portion of an ink-jet unit based on the serial printing scheme. Referring to FIG. 22, a plurality of discharge openings 82 are formed in a discharge opening surface 81 facing the printing object 1 through a predetermined gap (e.g., about 0.3 mm to 2.0 mm) at a predetermined pitch, and electrothermal transducers (heat generating resistors) 85 for generating energy for ink discharging are arranged along the wall surfaces of liquid paths 84 through which a common liquid chamber 83 communicates with the respective discharge openings 82.

The ink-jet unit (printhead) is mounted on, for example, a main scanning carriage such that the discharge openings 82 cross the main scanning direction. In this manner, the ink-jet unit is formed, in which an image (print signal) or discharge signal is used to drive (energize) the corresponding electro-thermal transducers 85 so as to cause film boiling in ink in the liquid paths 84, and the ink is discharged from the discharge openings 82 by the pressure generated at this time.

Figure 8:
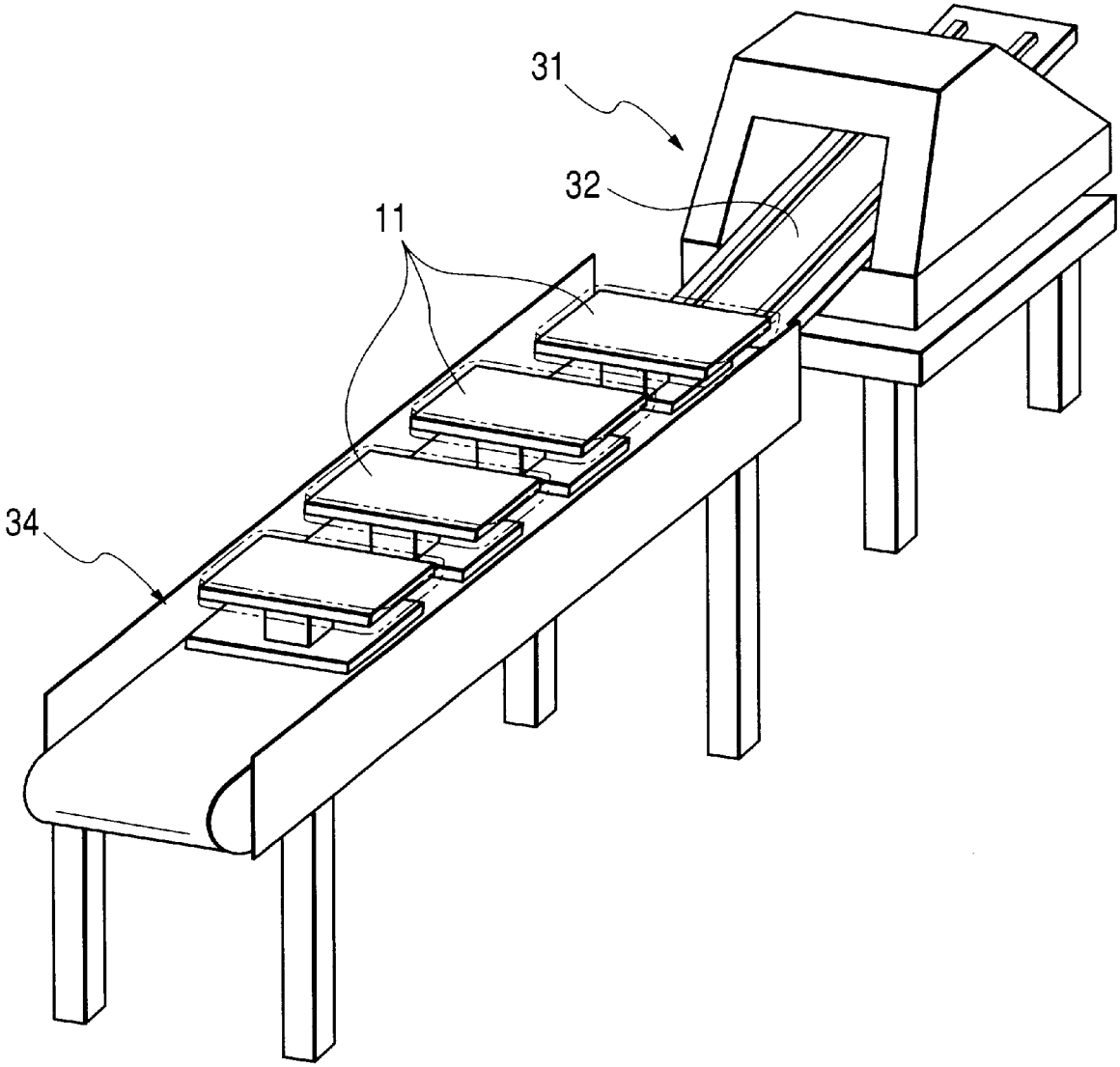
FIG. 8 is a schematic perspective view showing an example of an arrangement for consecutively and automatically conveying printing trays to the ink-jet printing mechanism in FIG. 7.

FIG. 8 is a schematic perspective view showing an example of an arrangement for consecutively conveying printing trays 11 to the ink-jet printing mechanism 31. Referring to FIG. 8, a loading belt 34 is installed in front of the ink-jet printing mechanism 31. A plurality of printing trays 11 are consecutively placed on the loading belt 34 to consecutively supply the printing trays 11 onto the stage 32 of the ink-jet printing mechanism 31. With this operation, the printing trays 11 are consecutively and automatically conveyed through the ink-jet printing mechanism 31. According to this arrangement, images can be automatically and consecutively printed on a plurality of printing objects (T-shirts or the like) 1.

Figure 9:
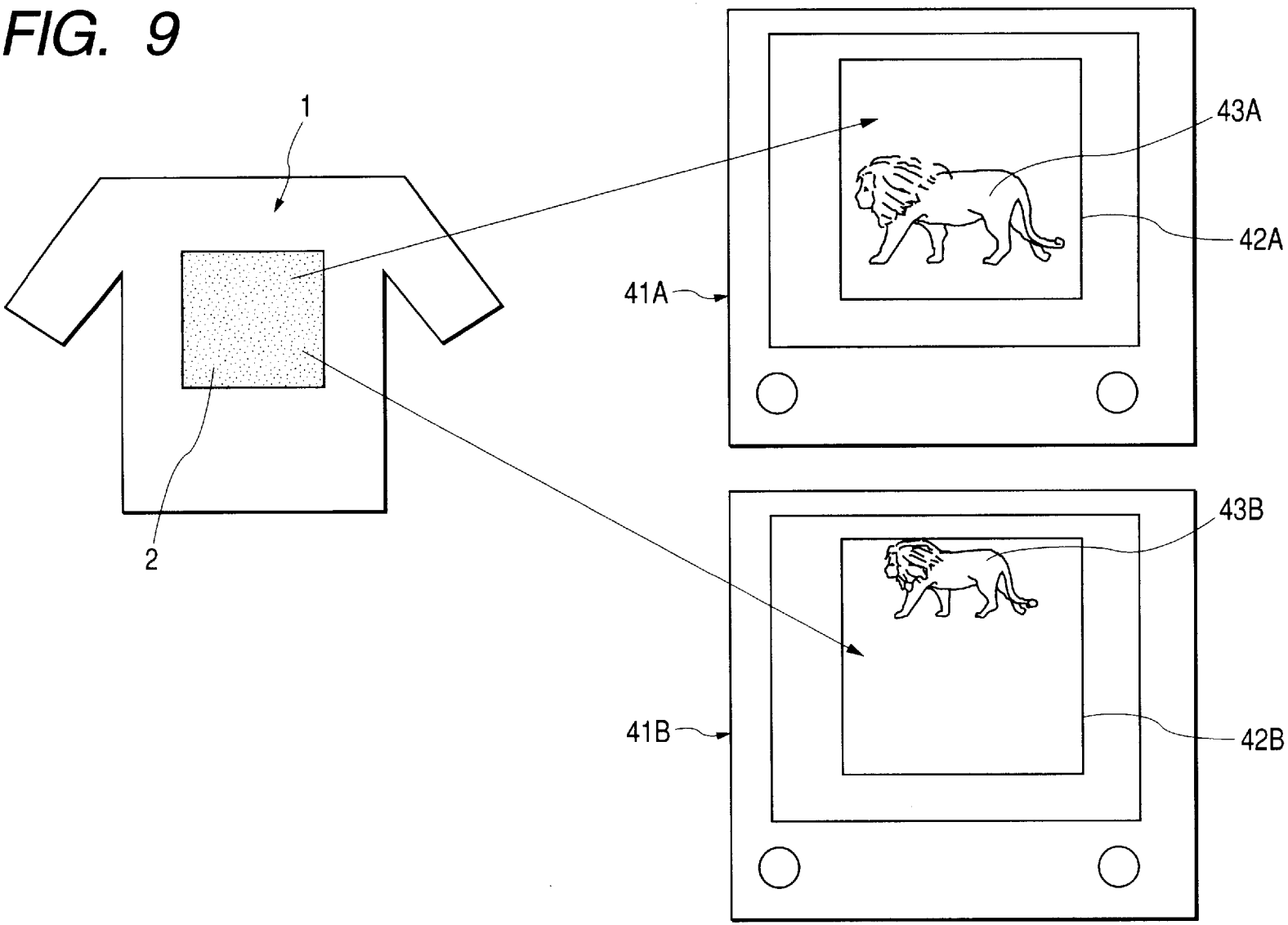
FIG. 9 is a conceptual view showing a method of processing inputting, printing and filing of a textile printing picture to be printed on a printing object by using a personal computer.

FIG. 9 is a conceptual view showing a method of inputting a textile-printing picture to be printed on a printing object, printing it on the printing object, and filing it by using a personal computer. The ink-jet textile printing system to which the present invention is applied includes a display screen on which only the partial pre-process portion (printing target range) 2 of the printing object 1 can be displayed as a printing picture arrangement area, and an image input/output means capable of printing the digital picture. Referring to FIG. 9, printing range frames 42A and 42B corresponding to the partial pre-process portion (the range coated with a preconditioning agent) 2 are displayed on the screens of displays 41A and 41B, and pictures 43A and 43B are arranged in the respective frames. The user selects either of the printing range frames 42A and 42B to print the selected picture. As a consequence, one of the pictures 43A and 43B which is displayed in the selected printing range frame is printed in the partial pre-process portion 2 of the printing object (T-shirt or the like) 1 in the same state as that of the picture displayed in the printing range frame.

Print information is filed such that image information such as a picture to be printed, a printing position, and a print size can be filed together with customer order information. According to this arrangement, a print can be easily copied on the printing object 1 without any change or with a partial change. Therefore, in on-demand printing in a tourist resort or theme park, a picture desired by a customer can be easily and reliably printed simply by placing/setting the image (picture) while having a conversation with the customer and looking at the printing range frames 42A and 42B.

Figure 10:
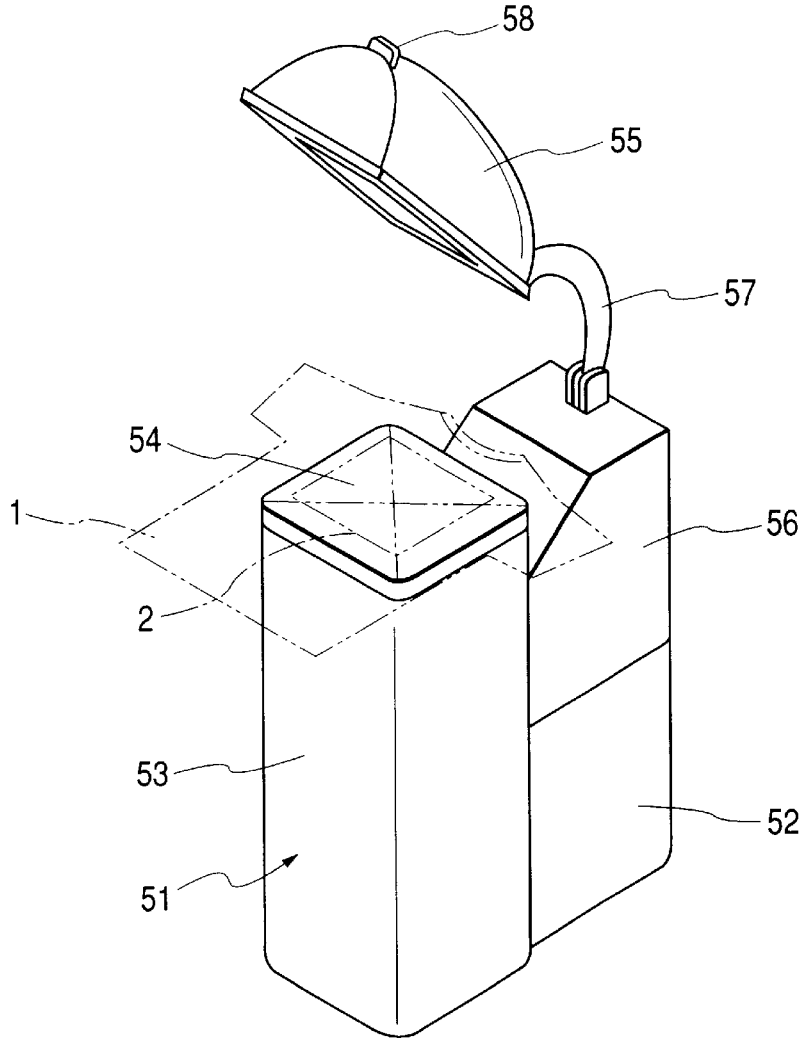
FIG. 10 is a schematic perspective view showing an example of an on-demand simple color developing machine suitably used in the ink-jet textile printing apparatus to which the present invention is applied.

FIG. 10 is a schematic perspective view showing an example of an on-demand simple color developing machine suitably used in the ink-jet textile printing apparatus to which the present invention is applied. Referring to FIG. 10, an on-demand simple color developing machine 51 includes a box-like steam generating unit 52 and box-like steam storage unit 53. A boiler is incorporated in the steam generating unit 52. A sponge 54 made of silicone or the like is attached to the upper surface of the steam storage unit 53. The steam storage unit 53 is configured to uniformly feed the steam sent from the steam generating unit 52 to the sponge 54.

The sponge 54 is formed to be slightly wider than the partial pre-process portion 2 of the printing object 1. A printing object such as a T-shirt on which a picture is printed is placed on the sponge 54. More specifically, the partial pre-process portion 2 is positioned/placed on the upper surface of the steam storage unit 53 (the upper surface of the sponge 54) while the partial pre-process portion 2 on which the picture is printed is positioned on the upper surface of the sponge 54.

After the printing object 1 is placed on the upper surface of the steam storage unit 53 in this state, a cover 55 is lowered to come into contact with the upper surface of the steam storage unit 53 so as to hermetically place the partial pre-process portion 2 of the printing object 1 inside the cover 55, thereby filling the inside of the cover 55 with steam.

The cover 55 is attached to the distal end portion of a lever 57 driven by an automatic opening/closing mechanism 56. That is, the cover 55 is swung/driven by the automatic opening/closing mechanism 56 through the lever 57 to be opened/closed with respect to the upper surface of the steam storage unit 53 (the upper surface of the sponge 54). In the case shown in FIG. 10, the automatic opening/closing mechanism 56 is placed on the steam generating unit 52. The cover 55 has a steam discharge opening 58 for controlling a steaming condition by properly discharging steam.

According to the simple color developing machine shown in FIG. 10, the fibers of the printing object 1 react with the ink adhering to the fibers upon printing owing to the moisture and heat of the steam uniformly discharged from the sponge 54 and filling the inside of the cover 55, thereby performing color developing/fixing of the printed image. According to the arrangement shown in FIG. 10, a compact steamer for steaming only the partial pre-process portion 2 will suffice. This makes it possible to decrease the size of the simple color developing machine 51.

Figure 11:
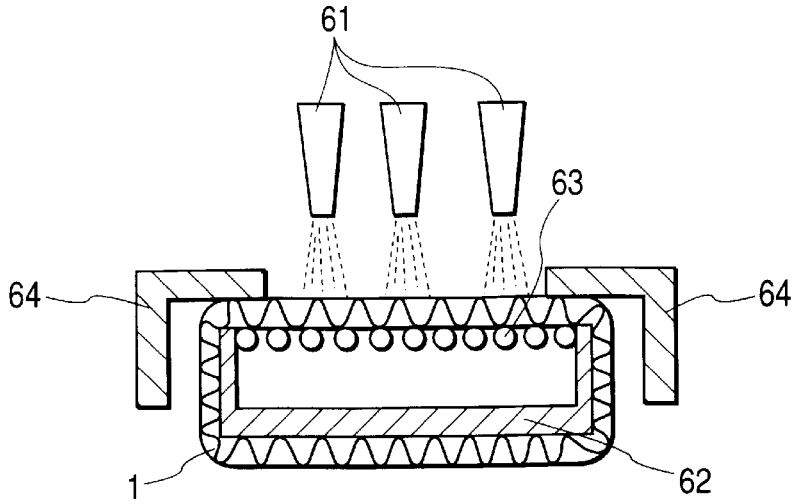
FIG. 11 is a schematic longitudinal sectional view showing an example of the structure of the main part of a cleaning apparatus for executing a cleaning step in a post-process in the textile printing process in FIG. 1.

FIG. 11 is a schematic longitudinal sectional view showing an example of the structure of the main part of a cleaning apparatus for executing the cleaning step in the post-process of the textile printing process shown in FIG. 1. Referring to FIG. 11, nozzles 61 are used for shower cleaning and hot air drying, and the drain tray 62 is covered with the printing object 1 such as a T-shirt. The bottom surface and left and right surfaces of the drain tray 62 are wall portions, and the upper surface is formed by a net 63.

In cleaning, the printing object 1 is placed on the drain tray 62 such that the partial pre-process portion 2 is aligned (positioned) on the upper surface formed by the net 63. Water or hot water is then sprayed (sprinkled) from the nozzles 61 against the partial pre-process portion 2 over a range wider than the partial pre-process portion 2 to shower-clean the partial pre-process portion 2, thereby washing out ink and a preconditioning agent from the partial pre-process portion 2.

By switching the shower-cleaning mode to the hot air drying mode afterward, the printing object 1 is dried. Referring to FIG. 11, covers 64 prevent a cleaning liquid from being applied to unnecessary portions other than the partial pre-process portion 2 of the printing object 1 or unnecessary portions other than the printed image region.

<Second Embodiment>

Figure 12:
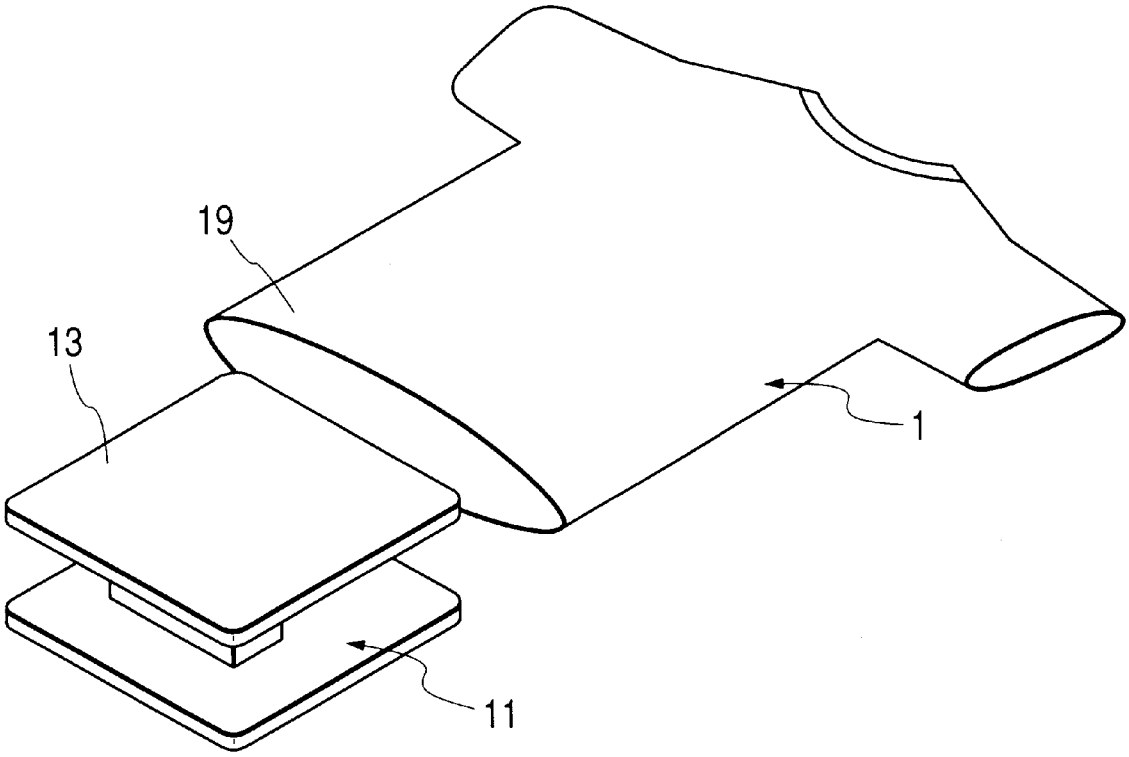
FIG. 12 is a schematic perspective view showing the second embodiment of the printing tray to which the present invention is applied.

FIG. 12 is a schematic perspective view showing the second embodiment of the printing tray. As shown in FIG. 12, a printing tray 11 may have an H-like shape like the one described above, and a printing object (T-shirt) 1 may be placed on an upper plate 13 to cover it such that only the upper surface of the printing object (T-shirt) 1 is located on the upper surface of the upper plate 13. With this arrangement, even if the printing object is a thin material, ink can be prevented from spreading to the lower surface of the printing object 1 in printing a picture on the printing object. In addition, adhesive members 15 like those shown in FIG. 5 may be attached to the printing tray 11 in FIG. 12.

<Third Embodiment>

Figure 13:
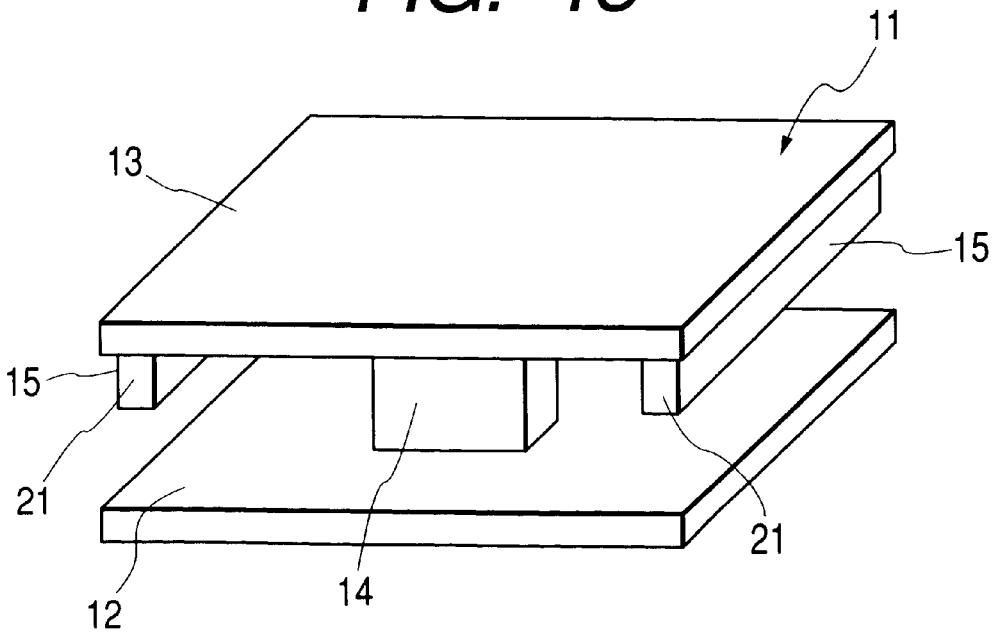
FIG. 13 is a schematic perspective view showing the third embodiment of the printing tray to which the present invention is applied.

FIG. 13 is a schematic perspective view showing the third embodiment of the printing tray. Referring to FIG. 13, a printing tray 11 has walls 21 formed on its side surface portions, and the outer surfaces of these walls are coated with adhesive members 15 such as an industrial paste or adhesive tapes, thereby providing the side surfaces of the printing tray 11 with an adhesive property.

The printing tray 11 in FIG. 13 differs from the printing tray (first embodiment) shown in FIGS. 5 and 6 in the above points, but has substantially the same arrangement in other respects. Therefore, the same reference numerals as in the above embodiment denote the same parts in this embodiment, and a detailed description thereof will be omitted.

Even with this arrangement, by lightly holding the printing object 1 on the printing tray 11, floating of the printing object from the printing surface formed on the upper surface of the printing tray and a positional shift during operation can be prevented as in the case of the first embodiment described above. According to the arrangement shown in FIG. 13, lateral protrusion of the printing object 1 from the side surfaces of the printing tray 11 can also be prevented.

<Fourth Embodiment>

Figure 14:
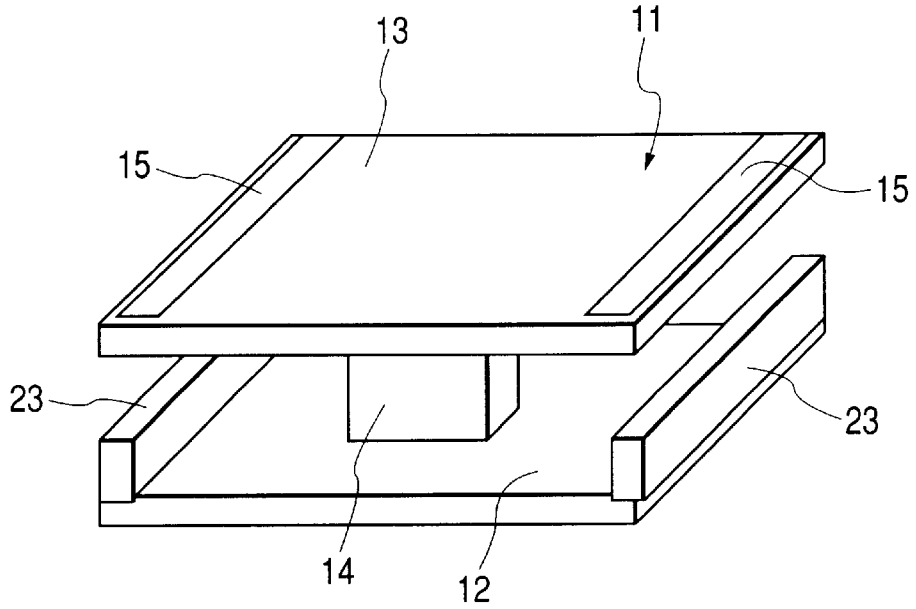
FIG. 14 is a schematic perspective view showing the fourth embodiment of the printing tray to which the present invention is applied.

FIG. 14 is a schematic perspective view showing the fourth embodiment of the printing tray. Referring to FIG. 14, adhesive members 15 similar to those in the first embodiment in FIG. 5 are attached to the upper surface of an upper plate 13 of a printing tray 11, and stoppers 23 for preventing protrusion of a cloth product 1 such as a T-shirt mounted on the printing tray are formed on edge portions (two opposing sides in FIG. 14) of the upper surface of a lower plate 12 of the printing tray 11. The printing tray in FIG. 14 differs from each of the printing trays according to the first embodiment in FIG. 5 and the third embodiment in FIG. 13 in the above points, but has substantially the same arrangement in other respects. Therefore, the same reference numerals as in the above embodiments denote the same parts in this embodiment, and a detailed description thereof will be omitted.

<Fifth Embodiment>

Figure 15:
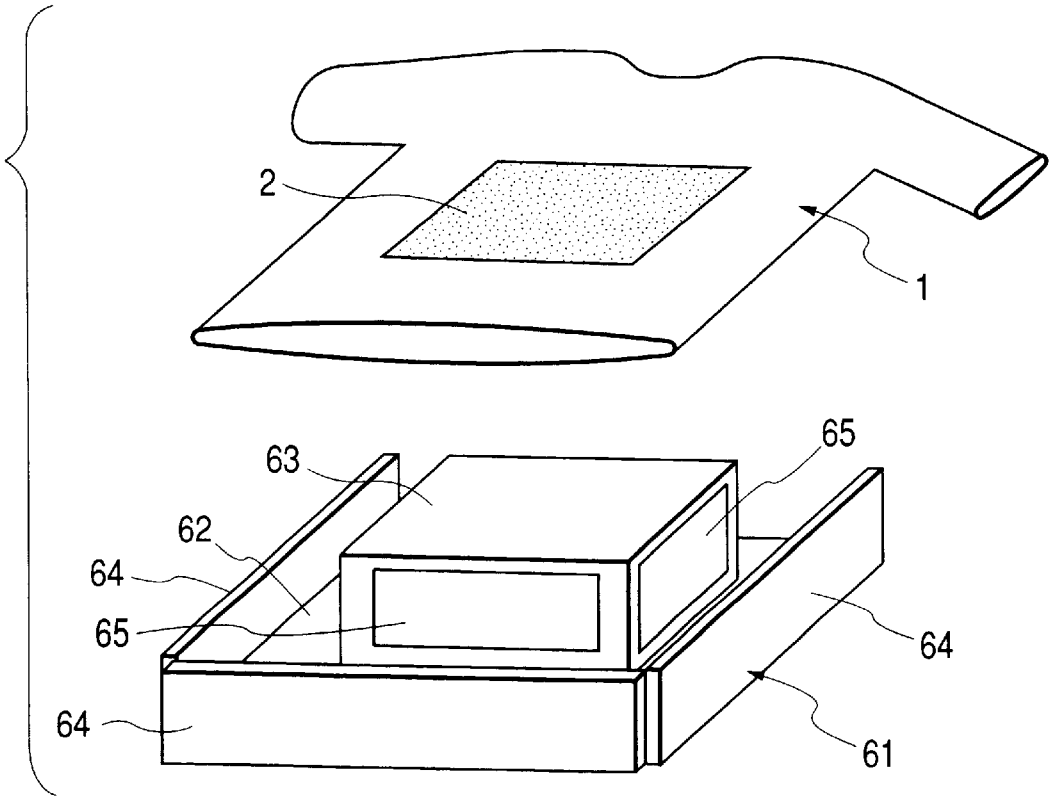
FIG. 15 is a schematic perspective view showing the fifth embodiment of the printing tray to which the present invention is applied and a printing object in a separate state.
Figure 16:
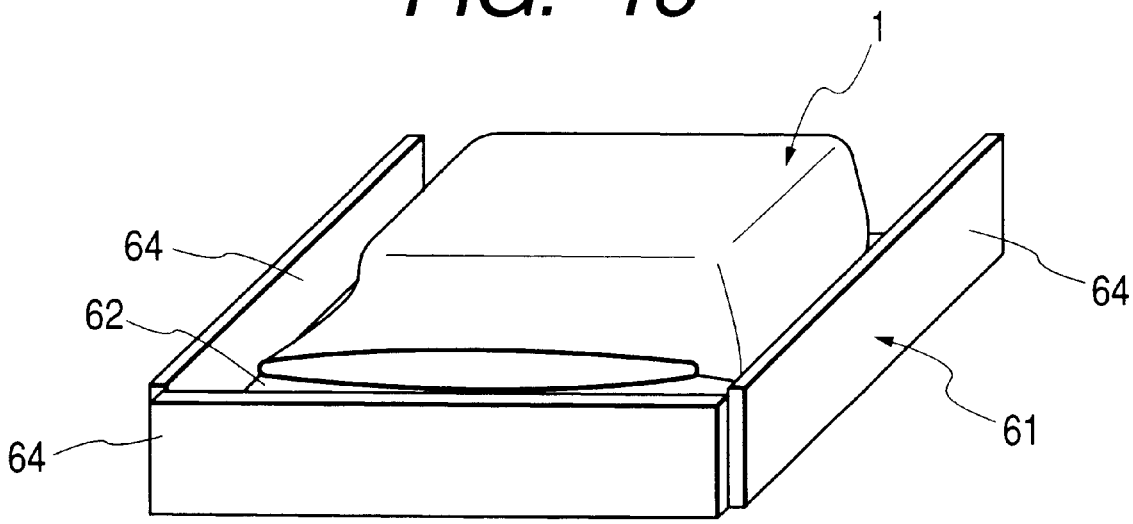
FIG. 16 is a schematic perspective view showing a state wherein the printing object in FIG. 15 is mounted on the printing tray in FIG. 15.

FIG. 15 is a schematic perspective view showing the fifth embodiment of the printing tray and a printing object (T-shirt) to be mounted on the tray in a separate state. FIG. 16 is a schematic perspective view showing a state wherein the printing object (T-shirt) is mounted on the printing tray in FIG. 15. Referring to FIGS. 15 and 16, a printing tray 61 according to the fifth embodiment is comprised of a lower plate 62, a block 63, and side plates 64 surrounding the block 63. With this arrangement, after a printing target range 2 of a T-shirt 1 is positioned/mounted on the block 63, a user is only required to let the remaining portions fall in the gap defined between the block 63 and the side plates 64, but need not put them inside the structure. This facilitates the mounting operation. In addition, since the block 63 can have large side surfaces, if the side surfaces are coated with an adhesive plate 65, there is no chance that the T-shirt 1 will shift during the printing operation. In addition, if the T-shirt 1 is held with slight tension, there is no chance that the T-shirt 1 will float and come into contact with the ink-jet head.

<Sixth Embodiment>

Figure 17:
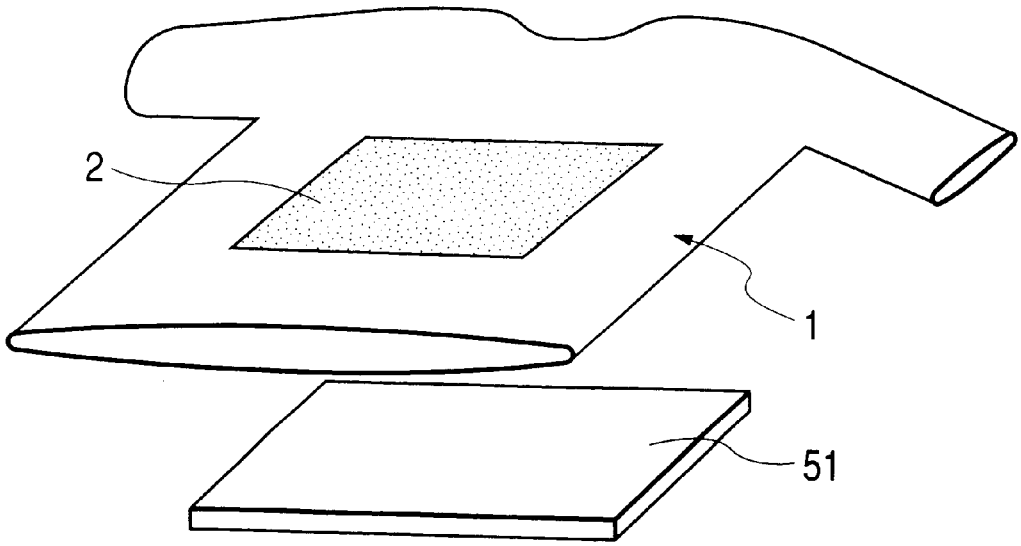
FIG. 17 is a schematic perspective view showing a printing object and holding plate in the sixth embodiment of the ink-jet textile printing apparatus to which the present invention is applied in a separate state.
Figure 18:
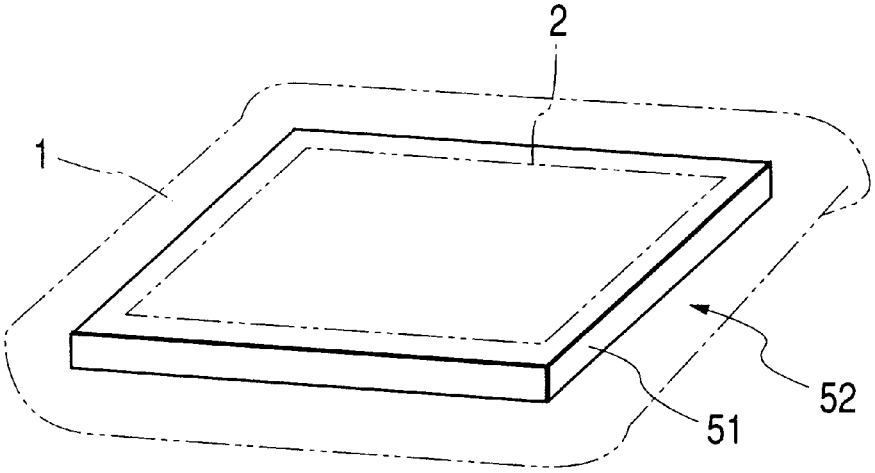
FIG. 18 is a schematic perspective view showing the state of a printing object unit obtained by attaching the printing object in FIG. 17 to the holding plate in FIG. 17.
Figure 19:
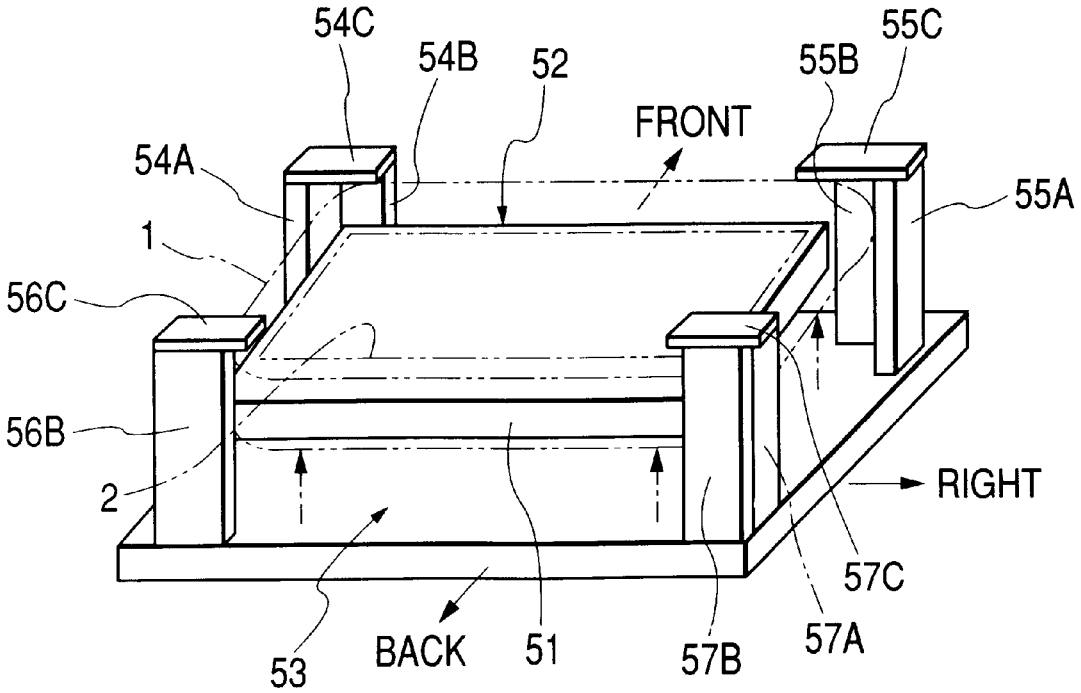
FIG. 19 is a schematic perspective view showing a state wherein the printing object unit in FIG. 18 is mounted on the printing tray in the sixth embodiment of the ink-jet textile printing apparatus to which the present invention is applied.
Figure 20:
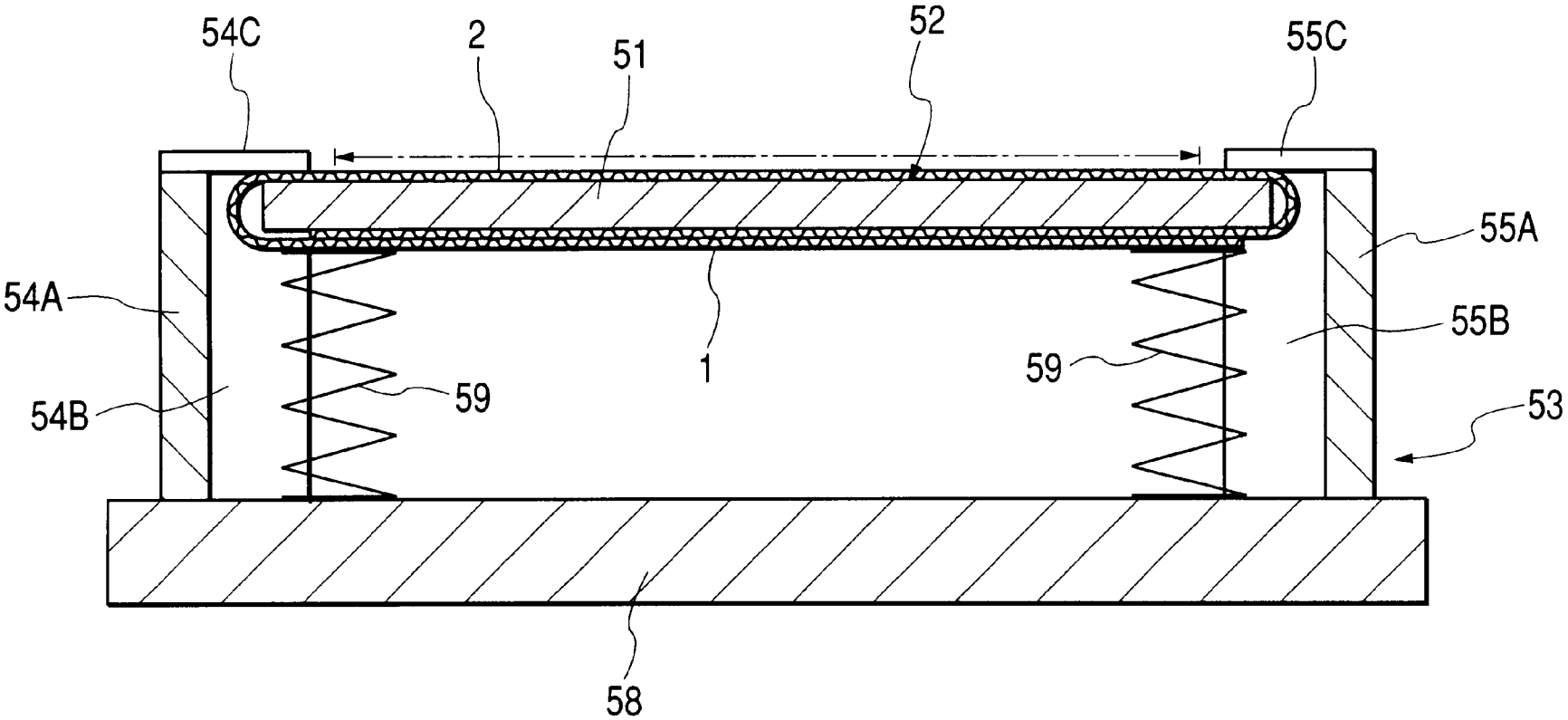
FIG. 20 is a schematic vertical-sectional view of the printing tray on which the printing object unit in FIG. 19 is mounted.
Figure 21:
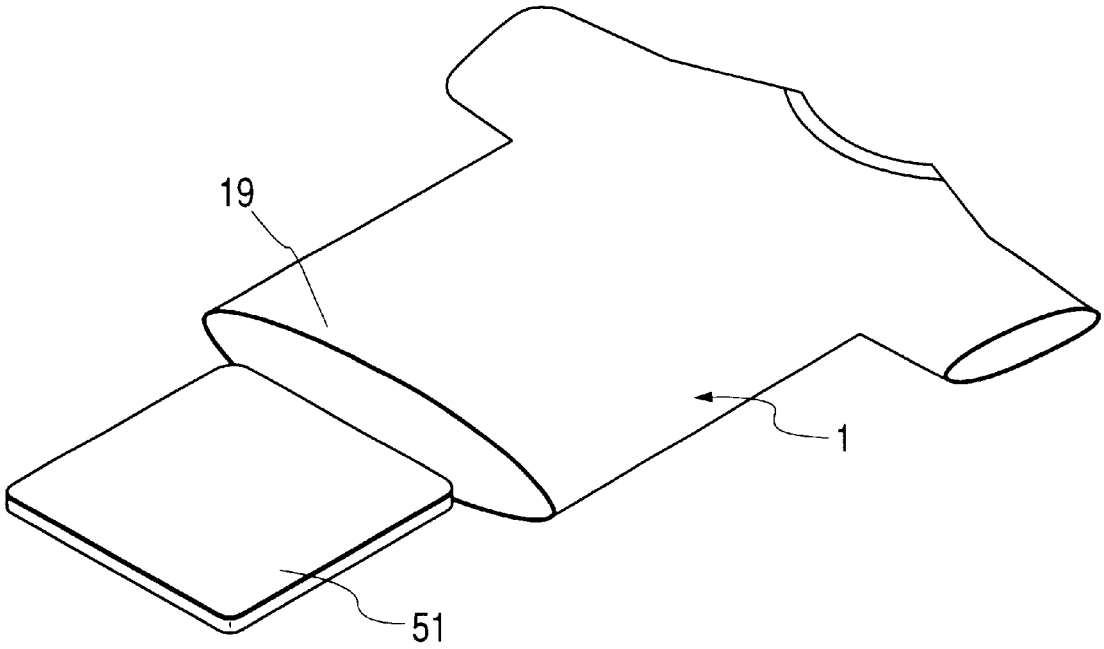
FIG. 21 is a schematic sectional view showing a printing object and a modification of the holding plate in the ink-jet textile printing apparatus to which the present invention is applied.

FIGS. 17 to 21 show the arrangement of the main part of the sixth embodiment of the ink-jet textile printing apparatus to which the present invention is applied. FIG. 17 is a schematic perspective view showing a printing object 1 and a holding plate 51 in a separate state. FIG. 18 is a schematic perspective view showing a state wherein the printing object is mounted on the holding plate (printing object unit). FIG. 19 is a schematic perspective view showing a state wherein the printing object unit (the holding plate on which the printing object is mounted) is attached to a printing tray. FIG. 20 is a schematic cross-sectional view of the printing tray on which the printing object unit in FIG. 19 is mounted. FIG. 21 is a schematic perspective view showing a printing object and a modification of the holding plate.

According to the above embodiment, in the pre-process, in particular, when the process portion of the printing object is to be coated with a preconditioning agent by using a spray or the like, the printing object must be attached to a special jig designed to expose only the process portion. In printing, the printing object 1 must be mounted on the printing tray. That is, the printing object 1 is attached/detached to/from these two types of jigs, and hence redundant operation is required. When color development fixing is to be performed in the post-process as well, it takes time to detach the printing object from the jig.

The sixth embodiment is configured to eliminate such inconvenience.

The sixth embodiment therefore uses a flat holding plate 51 whose size is set to be slightly larger than that of a printing target range 2 of a printing object 1, as shown in FIG. 17. The size of a holding plate 51 is set such that it can be held by upper surface guides 54C, 55C, 56C, and 57C (to be described later).

The holding plate 51 is positioned and brought into contact with the printing object (T-shirt) 1 from the lower side, and portions of the T-shirt 1 on which no printing is performed, e.g., arms 17, neck 18, and hem 19, are bent to the lower side and clipped, thereby attaching the printing object 1 to the holding plate 51. As a consequence, the printing object 1 is formed into the shape (form) shown in FIG. 18. Referring to FIG. 18, a printing object unit (T-shirt unit) 52 is equivalent to a state wherein the printing object 1 is attached to the holding plate 51. The upper surface of the printing object unit 52 is flat, but the lower surface on which the non-print portions are folded is uneven. The holding plate 51 is made of a plate member such as an aluminum plate, and hence has rigidity as well as flatness.

The printing object unit 52 is mounted on a printing tray 53 like the one shown in FIGS. 19 and 20. Referring to FIGS. 19 and 20, the printing tray 53 has a structure in which left and right positioning guides, front and read positioning guides, and upper surface guides are formed on a lower plate 58. More specifically, left and right positioning guides 54A, 55A, 56A, and 57A, front and rear positioning guides 54B, 55B, 56B, and 57B, and upper surface guides 54C, 55C, 56C, and 57C mounted on the upper end faces of the left, right, front, and rear positioning guides are formed on the four corner portions of the upper surface of the lower plate 58. The upper surface guides 54C, 55C, 56C, and 57C serve to define the height position of the printing object unit 52 mounted on the printing tray. The printing object unit 52 is elastically held between spring means (compression springs) 59 mounted on the lower plate 58 to produce upward biasing force and the upper surface guides 54C, 55C, 56C, and 57C, thereby accurately regulating the position of the printing target range 2 of the printing object 1 in the height direction.

Note that the upper surface guides 56C and 57C on the rear side can move in the escaping direction (retreating direction) to avoid interference with the inserted printing object unit 52. When the printing object unit 52 is mounted on the printing tray 53, these guides are moved in the escaping direction. After the printing object unit 52 is mounted, the upper surface guides 56C and 57C are returned to the initial positions. As described above, the elastic force generating means (not shown) for pushing the mounted printing object unit (T-shirt unit) 52 upward are arranged below the upper surface guides 54C, 55C, 56C, and 57C. After the movable upper surface guides 56C and 57C are returned to the initial positions, the printing object unit (T-shirt unit) 52 is pressed against the lower surfaces of the upper surface guides 54C, 55C, 56C, and 57C by the elastic force generating means to keep the printing target range of the printing object 1 flat and regulate its position in the height direction.

Note that the upper surface guides 54C, 55C, 56C, and 57C are arranged on the outer end portions outside the printing target range 2, and each upper surface guide is formed to have a thickness that prevents the guide from coming into contact with the ink-jet head (discharge opening surface) (a thickness smaller than the gap between the discharge opening surface and the printing target range, e.g., 0.6 mm to 0.8 mm). With this arrangement, the printing tray 53 on which the printing object 1 (printing object unit 52) is mounted can be set in the ink-jet printing mechanism 31 (FIG. 7) without any change of state.

FIG. 21 is a schematic perspective view showing the printing object 1 described above and a modification of the holding plate 51. As shown in FIG. 21, even if the printing object (T-shirt) 1 is placed such that only the upper surface of the printing object 1 is located on the upper surface of the holding plate 51, and is made of a thin material, this system may be designed to prevent ink from spreading to the lower surface of the printing object 1 in printing a picture on the printing object. The remaining portions of the sixth embodiment described with reference to FIGS. 17 to 21 are substantially the same in arrangement as those in the first embodiment, and a detailed description thereof will be omitted.

According to the embodiment described above, a print can be directly and easily textile-printed on a cloth product such as a T-shirt on demand. Therefore, there is provided an ink-jet textile printing system which can easily and reliably perform on-demand printing of a picture in a tourist resort or theme park.

More specifically, a printing object 1, only a specific printing target range 2 of which has undergone a partial pre-process, is stocked as a standard product. In printing operation, the printing tray 11 for conveying the printing object 1 while positioning the partial pre-process portion 2 of the printing object with respect to an ink-jet printing mechanism 31 is used. Whereby, a picture can be directly printed on the printing object 1. In addition, on-demand textile printing is facilitated by eliminating the necessity of the steps of applying a preconditioning agent and drying it in printing operation. This makes it possible to easily perform textile printing on the cloth product 1 such as a T-shirt on demand. In addition, there is provided a compact, inexpensive ink-jet textile printing system which can meet the demands for original prints and create new demands for print cloth products as commemorative goods in tourist resorts, theme parks, and the like.

Since a printing target range (the range of partial pre-process portion) is specified and standardized, the same pre-process can be performed for a large number of pre-process portions. This makes it possible to greatly reduce the pre-process cost.

In addition, as compared with the conventional textile printing technique of dipping an entire printing object which is a cloth product such as a T-shirt, the amount of preconditioning agent used can be minimized. Furthermore, since the drying time after the application of a preconditioning agent or cleaning can be shortened, shrinkage and torsion of the cloth product such as a T-shirt can be minimized.

Since both color development fixing and cleaning need be performed for only a specific portion, the color developing machine and cleaning apparatus can be reduced in size and cost. This also makes it possible to shorten the post-process time and simultaneously perform partial cleaning. Shrinkage and torsion of a cotton product like a T-shirt which are caused in the drying step can be minimized.

The range of the portion having undergone a pre-process (partial pre-process) can be easily identified by marking the partial pre-process portion 2 with a chalk pen, seal, or the like or with a colored preconditioning agent. Therefore, by making the size of the printing object mount portion of the printing tray almost equal to that of the marking or colored pre-process portion, positioning of the partial pre-process portion with respect to the printing tray is facilitated, thus facilitating positioning of the transfer switch with respect to the ink-jet printing mechanism.

In general, textile printing by an ink-jet printing is performed to dye only the surface of a cloth material. For this reason, by pre-processing only the surface of the cloth product by spray coating or the like, the merit of the partial coating process for only the pre-process portion is enhanced, and spreading of the preconditioning agent from the partial pre-process portion can be prevented. This makes it possible to easily and reliably position the cloth product with respect to the printing tray.

Owing to digital textile printing using an ink-jet printing mechanism, any type of digital picture can be printed on the spot without any plate. This further facilitates the on-demand operation.

Furthermore, since a printing target range for which a partial pre-process is to be performed is made almost equal to A4 size, both A4 landscape and A4 portrait pictures can be processed without changing the method of mounting a printing object on the printing tray.

Moreover, the ink-jet printer can exert its high-resolution printing function, which is a characteristic feature of the printer. In addition, the finished product obtained by textile printing is excellent in smoothness, washing fastness, and the like.

What is claimed is:

1. An ink-jet textile printing system comprising:

an ink-jet printing mechanism capable of textile printing on a printing object;

a printing tray for holding a printing target range of the printing object flat, and conveying the printing object while positioning the printing target range with respect to said ink-jet printing mechanism; and a printing object having a partial pre-process portion obtained by partially pre-processing only the printing target range, wherein the partial pre-process portion is made identifiable by partially pre-processing the portion with a colored preconditioning agent.

2. An ink-jet textile printing apparatus having an ink-jet printing mechanism capable of textile printing on a printing object, comprising:

means for performing a partial pre-process for only a specific printing target range of the printing object;

means for positioning the printing object and mounting the printing object on a printing tray while holding and positioning a partial pre-process portion flat, and positioning and conveying the printing object for printing and with respect to the ink-jet printing mechanism by using the printing tray, image input/output means capable of arranging a digital picture on a display screen capable of displaying only the partial pre-process portion as a printing picture arrangement area, and printing the digital picture; and color development means for performing color development fixing for only the partial pre-process portion after printing, wherein processing from the pre-process to the color development fixing is performed for only the partial pre-process portion.

3. An apparatus according to claim 2, further comprising cleaning means for cleaning only the partial pre-process portion, wherein processing from color development fixing to cleaning is performed for only the partial pre-process portion.

4. An apparatus according to claim 2, wherein the printing object is mounted on the printing tray while the partial pre-process portion is held flat with respect to the printing tray, and a remaining portion is folded inside.

5. An apparatus according to claim 2, wherein the printing object is mounted on the printing tray while the partial pre-process portion is held flat with respect to the printing tray, and a remaining portion is dropped below a peripheral portion of the tray.

6. An apparatus according to claim 2, wherein the printing tray is formed into an H-like shape, and the printing object is mounted on the printing tray so as to cover the tray, thereby preventing ink from spreading to a lower surface of the printing object.

7. An apparatus according to claim 2, wherein said ink-jet printing mechanism comprises ink-jet means having an electrothermal transducer for generating heat energy used to discharge ink.

8. An apparatus according to claim 7, wherein said ink-jet means discharges ink from a discharge opening by using film boiling caused in the ink by the heat energy generated by said electrothermal transducer.

9. An ink-jet textile printing method of textile-printing an image on a printing object using an ink-jet printing mechanism, comprising the steps of:

performing a partial pre-process for only a specific printing target range of the printing object;

positioning and mounting the printing object on a printing tray while holding and positioning a partial pre-process portion flat, and positioning the printing object for printing and conveying the printing object with respect to the ink-jet printing mechanism by using the printing tray;

preparing image input/output means capable of arranging a digital picture on a display screen capable of displaying only the partial pre-process portion as a printing picture arrangement area, and printing the digital picture, and color development means for performing color development fixing for only the partial pre-process portion after printing; and performing processing from the pre-process to the color development fixing for only the partial pre-process portion.

* * * * *